United States Patent [19]

Thompson

[11] 4,319,752

[45] Mar. 16, 1982

[54] METAL SHELL GOLF CLUB HEAD, WITH KEEL

[76] Inventor: Stanley C. Thompson, 7851 Talbert St., Apt. 1, Playa del Rey, Calif. 90271

[21] Appl. No.: 170,957

[22] Filed: Jul. 21, 1980

[51] Int. Cl.[3] ..... A63B 53/04

[52] U.S. Cl. ..... 273/171; 273/167 A; 273/167 H; 273/174

[58] Field of Search ..... 273/167–174, 273/72 A

[56] References Cited

U.S. PATENT DOCUMENTS

| | | | |
|---|---|---|---|
| 645,944 | 3/1900 | Dalgleish | 273/174 X |
| 1,868,286 | 7/1932 | Grieve | 273/174 |
| 1,913,821 | 6/1933 | Stumpf | 273/171 |
| 3,692,306 | 9/1972 | Glover | 273/171 X |
| 3,761,095 | 9/1973 | Thompson | 273/174 |
| 3,897,066 | 7/1975 | Belmont | 273/171 |
| 3,961,796 | 6/1976 | Thompson | 273/171 X |
| 3,972,528 | 8/1976 | McCracken et al. | 273/72 A |
| 4,021,047 | 5/1977 | Mader | 273/167 H |
| 4,139,196 | 2/1979 | Riley | 273/167 H X |
| 4,145,052 | 3/1979 | Janssen et al. | 273/171 |
| 4,214,754 | 7/1980 | Zebelean | 273/167 H |

FOREIGN PATENT DOCUMENTS

| | | | |
|---|---|---|---|
| 105959 | 11/1938 | Australia | 273/171 |
| 679292 | 9/1952 | United Kingdom | 273/167 H |
| 1476889 | 6/1977 | United Kingdom | 273/167 H |

*Primary Examiner*—Richard J. Apley
*Attorney, Agent, or Firm*—William W. Haefliger

[57] ABSTRACT

A golf club head comprises: p1 (a) a metallic shell having the exterior form of said head, (b) the head having a front face adapted to strike a golf ball, and upper and lower surfaces, said lower surfaces defining a downwardly projecting keel which extends rearwardly relative to said front face, the keel having a downwardly convex surface which is forwardly and rearwardly elongated, said lower surface of the head having underside faces at opposite sides of the keel with each such face having downwardly concavity, (c) said keel defining a portion of said shell.

5 Claims, 8 Drawing Figures

METAL SHELL GOLF CLUB HEAD, WITH KEEL

BACKGROUND OF THE INVENTION

This invention relates generally to golf clubs, and more particularly to "wood" heads constructed of metal such as steel.

U.S. Pat. No. 3,761,095 describes an improved "wood" head that incorporates a keel. One function of the keel is to provide for minimum contact of the head with the turf, as for example when the head is urged to drive a golf ball from the rough, whereby a longer distance "hit" is achieved. That head incorporates a thick sole plate attached to the body of the wooden head, and defining the keel. No provision is made for attachment of a keel to a thin walled, metal shell defining the head.

SUMMARY OF THE INVENTION

It is a major object of the invention to provide an improved metallic "wood" head, incorporating a keel. Fundamentally, the invention is defined by:

(a) a metallic shell having the exterior form of said head, (b) the head having a front face adapted to strike a golf ball, and upper and lower surfaces, said lower surface defining a downwardly projecting keel which extends rearwardly relative to said front face, the keel having a downwardly convex surface which is forwardly and rearwardly elongated, said lower surface of the head having underside faces at opposite sides of the keel with each such face having downward concavity, (c) said keel defining a portion of said shell.

As will appear, the shell and keel may both consist of thin walled steel, whereby the shell interior is hollow and a portion of that hollow interior continues into the keel; those interiors may be filled with synthetic plastic material to impart a feel of solidity to the head and club shaft when a golf ball is struck; the mass of the steel at the toe and heel of the head provides momentum imparted to opposite ends of the front face, whereby unwanted "turning" of the head during striking of a ball is resisted; part of the shell may comprise a thin walled plate attached as by welding to an opening in the shell and via which the plastic material (to be reacted) is introduced into the shell interior, and that plate may carry the keel; weight means may be carried by the shell to project interiorly thereof, such weight means typically comprising a container for weight particles; the container may be carried by the plate referred to, and access to the container may be provided through an opening in the plate closed by a screw or other fastener, to close the opening after sufficient particles have been introduced. The container is supported sidewardly by the expanded plastic in the hollow interior.

These and other objects and advantages of the invention, as well as the details of an illustrative embodiment, will be more fully understood from the following description and drawings, in which:

DRAWING DESCRIPTION

DETAILED DESCRIPTION

Figure 1:
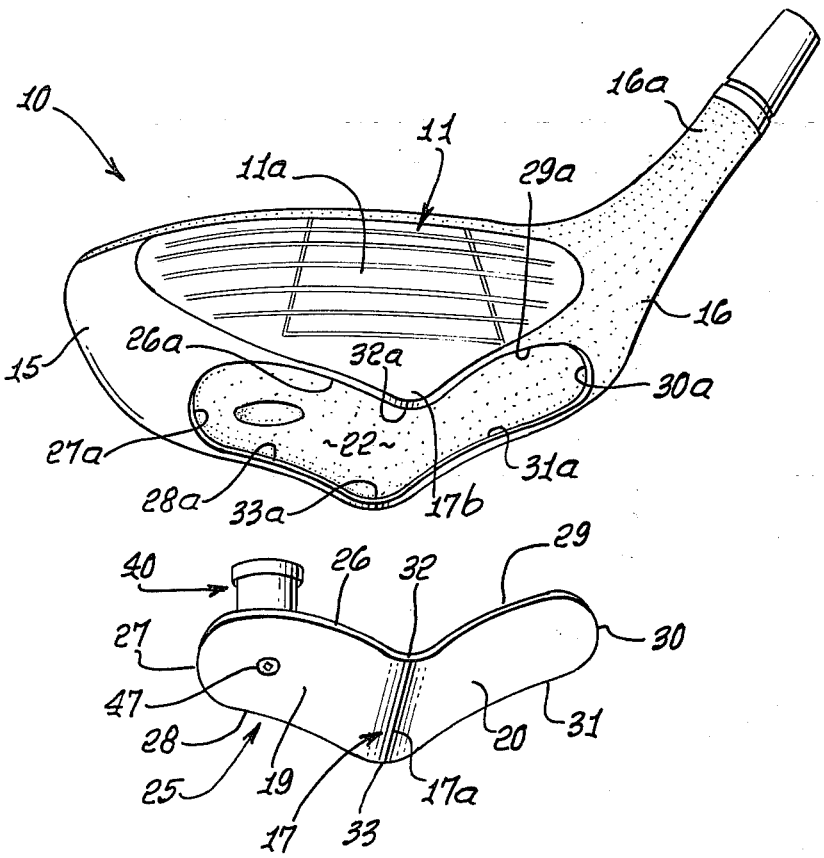
FIG. 1 is a perspective, exploded view of the front face and underside of a golf club head, with thin keel plate separated from the head shell.
Figure 2:
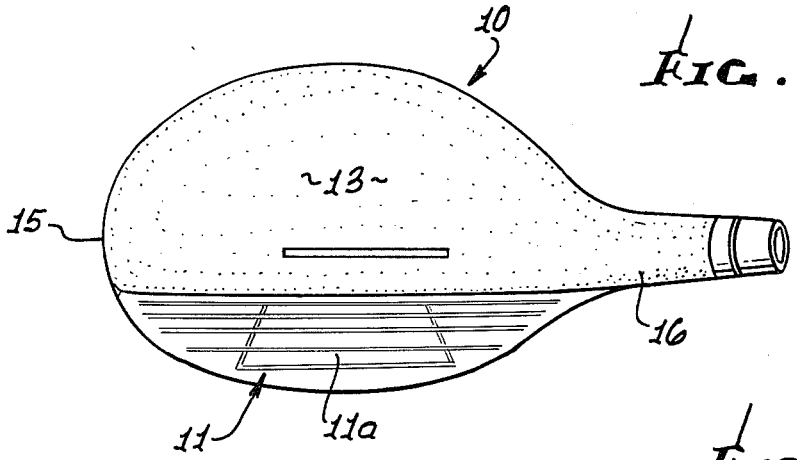
FIG. 2 is a top plan view of the FIG. 1 head.
Figure 3:
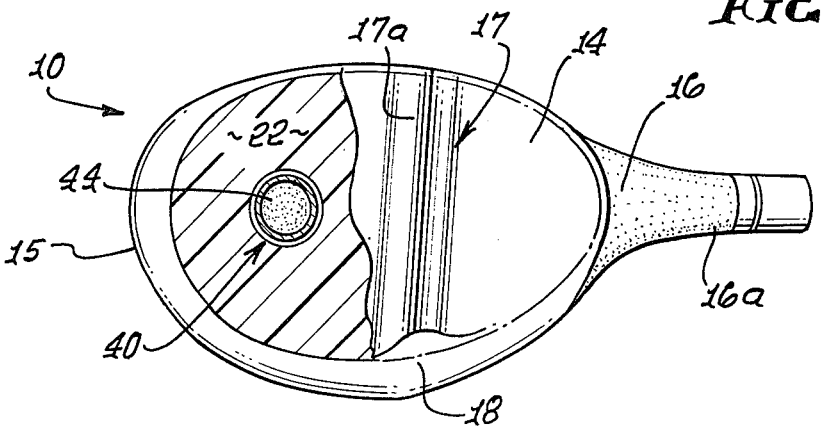
FIG. 3 is a bottom plan view of the FIG. 1 head, partly broken away to show an opening in the head shell bottom.

In the drawings, the golf club head 10 comprises a thin, metallic shell having the exterior form of "wood" head. Preferably, the metal of the shell is steel. The head includes a front face 11 adapted to strike a golf ball 12, and upper and lower surfaces 13 and 14. Also, the head includes a toe portion 15 and a heel portion 16. A hosel appears at **16*a***.

Figure 4:
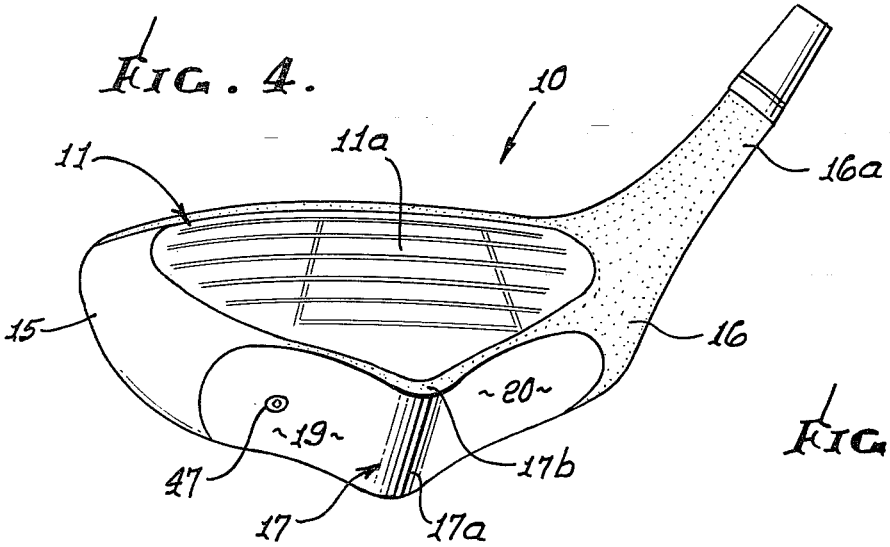
FIG. 4 is a view like FIG. 1, but showing the completed club head.

The lower surface 14 defines a downwardly projecting keel 17 which extends rearwardly (see FIG. 4) relative to the front face. The keel has a downwardly convex lowermost surface **17*a* which is forwardly and rearwardly elongated to extend toward the rearwardmost portion of the head, indicated at 18. Also the lower surface 14 of the head has underside faces 19 and 20 at opposite sides of the keel, and which have downward concavity, those faces merging with opposite sides of the keel. In use, if there is contact of the head with the ground, the only (or major) area of contact is defined by the keel. Concave faces 19 and 20** set up a favorable air flow adjacent the underside of the head as it is swung, and the keel splits the air flow which tends to separate and bend the grass as the head approaches the ball, rather than crush the grass as a conventional flat bottomed head does.

Figure 5:
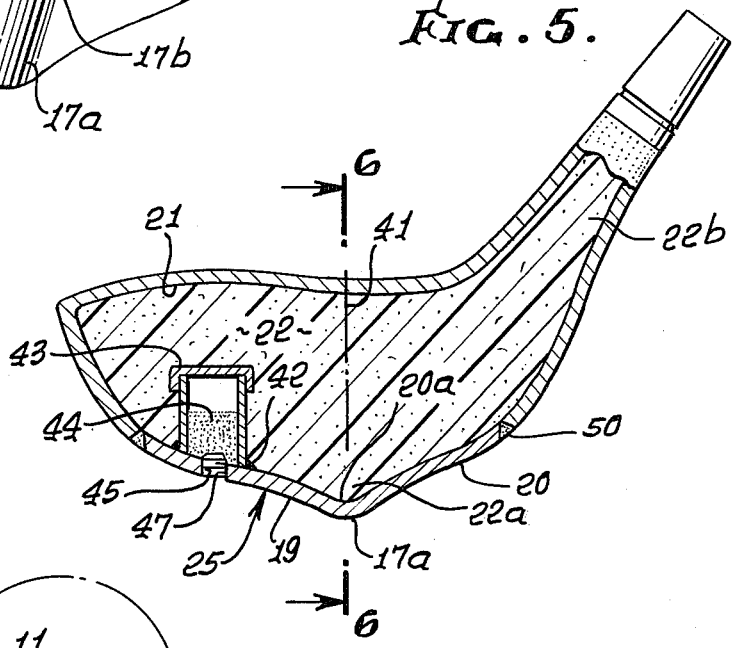
FIG. 5 is a vertical section, in the head to toe plane, through the completed club head.

The metallic shell defines a hollow interior 21, and a portion **20*a* of that hollow interior is defined by the keel. Synthetic plastic material 22 (such as foam) substantially fills the hollow interior 21, including portion 20*a* defined by the keel. Thus, the plastic material includes a downwardly protuberant "keel shaped" portion 22*a*, within the keel hollow interior (see FIG. 5**).

The effect of the foamed plastic material (which may consist of polyurethane) is to give a feeling of solidity to the head during striking of the golf ball; i.e., any inward or rearward deflection of the front face 11 of the club, as at the "sweet spot" **11*a* and at the front 17*b* of the keel, during striking of a golf ball, is forcibly transmitted to the resiliently deflectible or compressible lightweight plastic filler 22 and 22*a***. It should also be pointed out, that the momentum of the mass of the steel concentrated at the toe and heel portions of the steel head resists such rearward deflection of those locations, whereby the ball may be mis-struck at regions of the front face between the center (sweet spot) and toe and heel with less deleterious effect in terms of hook and slice (for example) than with a standard wood. This favorable effect when combined with the benefits of the keel provides a superior head, both structurally and functionally.

The shell includes an integral plate portion peripherally connected (as by welding) to the remainder of the shell, to close an opening in the latter via which the synthetic plastic material is introduced into the hollow interior, as during fabrication. The plastic is introduced prior to expansion as a result of catalytic reaction. The plastic fills the hosel at 22*b*. Note weld 50.

In FIGS. 1–5, that plate portion is indicated at 25 as carrying the keel 17 and as forming the concave faces 19 and 20. Plate portion has shallow butterfly V-shape, with arcuate front, lateral side and rear peripheral edges indicated at 26–31. Front and rear lowermost peripheral edges 32 and 33 of the plate are integral with the keel and merge with front and rear keel portions 17*a* and 17*b* defined by the remainder of the shell into which plate portion 25 peripherally fits. Note edges 26*a*–33*a* of that shell remainder, and to which plate portion edges 26–33 may be welded, to provide a closed shell. Grinding after fabrication provides a smoothly contained head undersurface 14, and if desired the undersurface of the plate 25 may be polished.

Figure 7:
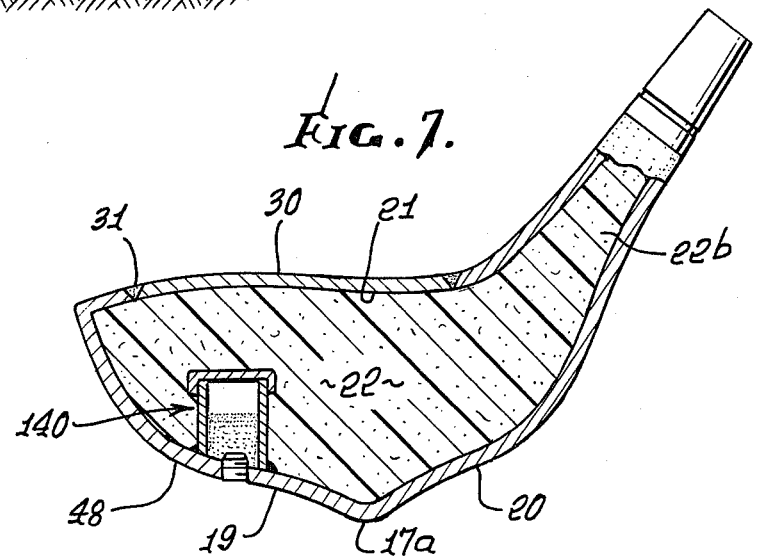
FIG. 7 is a view like FIG. 5, but showing a modification.

In FIG. 7, the modified plate 30 is at the top side of the head, and has an arcuate looping periphery welded to the remainder of the shell at 31. Plate 30 is spaced directly over the keel.

In accordance with a further aspect of the invention, weight means is carried by the shell, interiorly thereof, for accurate balance purposes. As appear in FIGS. 1 and 5, a weight container 40 is carried by plate 25, at the innerside thereof, and between the toe 15 of the head and a vertical plane 41 that passes forwardly through the keel (and bisects the latter). Also, as shown, the weight container is closer to an inner and upwardly convex surface (above outer and lower concave surface 19) than to the inner and upwardly concave surface portion or extent 20*a*. That container may consist of metal such as steel, and may be connected as by welding at 42, to the plate. The container is capped at 43, and surrounded by synthetic plastic 22. Sufficient weight particles 44, such as tungsten or other metal, are introduced into the container, as via an opening 45 in the plate, to provide accurate balance. The opening 45 is closed as by a threaded closure (screw for example) at 47.

Figure 8:
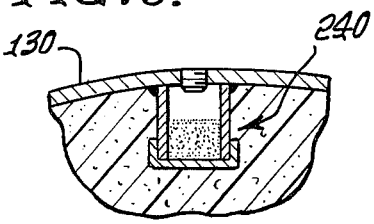
FIG. 8 is an edge view of a head plate to carry a weight container.

In FIG. 7, the weight container 140 is carried by the shell wall 48, and not by the plate 30. Container 140 corresponds to container 40 in FIG. 5. In FIG. 8, the container 240 is carried by the plate 130. The latter corresponds to plate 30 in FIG. 7, and container 240 corresponds to container 40 and 140.

Figure 6:
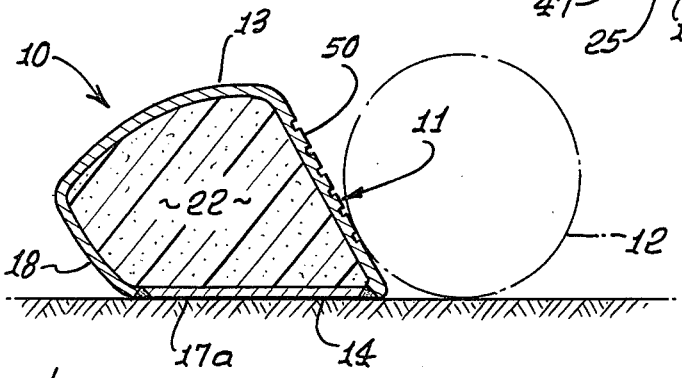
FIG. 6 is a vertical section through the FIG. 5 head, taken on lines 6—6 of FIG. 5.

In FIG. 6, the thickness of the front wall 50 defining face 11 is typically between 0.105 and 0.125 inches, and the thickness of the remainder of the shell is between 0.030 and 0.050 inches.

I claim:

1. A golf club head, comprising (a) a metallic shell having the exterior form of said head, (b) the head having a front face adapted to strike a golf ball, and upper and lower surfaces, said lower surface defining a downwardly projecting keel which extends rearwardly relative to said front face, the keel having a downwardly convex surface which is forwardly and rearwardly elongated, said lower surface of the head having underside faces at opposite sides of the keel with each such face having downwardly concavity, (c) said keel defining a portion of said shell, (d) the shell defining a hollow interior, a portion of which lies adjacent an upwardly concave inner surface of the keel, (e) foamed synthetic plastic material filling said hollow interior including said portion adjacent said inner concave surface of the keel, and (f) a metallic weight structure attached to the shell at the inner side thereof and projecting to substantial extent into said hollow interior to be sidewardly surrounded and engaged by said foamed synthetic plastic material, said weight structure being everywhere offset from said inner concave surface of the keel, the keel also having upwardly convex inner surface extent, and the weight structure also extending closer to said keel upwardly convex inner surface extent than to said keel upwardly concave inner surface extent, (g) the shell having an integral metallic plate portion peripherally weld connected to the remainder of the shell, said integral plate portion forming said keel and also defining said concave underside faces whereby said plate portion has butterfly V-shape, said plate portion having forward edges extending forwardly sufficiently to be welded to downwardly V-shaped extent of said front face, and having rearward edges located at the rearward periphery of said keel and welded to rearward extent of the head, (h) the shell having a toe and a heel at opposite sides of a vertical plane passing forwardly through the keel, said weight structure located between said plane and said toe and carried by the plate portion intermediate said forward and rearward edges thereof.

2. The head of claim 1 wherein the shell consists of steel, and the head is in the form of a wood.

3. The head of claim 1 wherein said weight structure includes a weight container carried by said plate portion and projecting in said hollow interior, and including weight particles in said container.

4. The head of claim 3 including an opening in said plate and communicating with the interior of said weight container, and a closure in said opening.

5. The head of claim 4 wherein said closure comprises a threaded closure threadably attached to said plate.

* * * * *